US006484882B1

(12) United States Patent
Boretzky et al.

(10) Patent No.: US 6,484,882 B1
(45) Date of Patent: Nov. 26, 2002

(54) PLANT FOR THE PROCESSING OF RESIDUE FROM A THERMAL WASTE DISPOSAL PLANT

(75) Inventors: Joachim Boretzky, Adelsdorf (DE); Anton Ebert, Ellwangen-Schrezheim (DE); Leonhard Teschers, Gundelfingen/Donau (DE); Winfried Von Rhein, Freigericht (DE); Helmut Werdinig, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/718,893

(22) Filed: Nov. 22, 2000

Related U.S. Application Data

(63) Continuation of application No. PCT/DE99/01449, filed on May 12, 1999.

(30) Foreign Application Priority Data

May 22, 1998 (DE) ..... 198 22 993

(51) Int. Cl.[7] ..... B07B 9/00; F23G 5/12

(52) U.S. Cl. ..... 209/19; 209/44.3; 209/476; 209/682; 110/229; 110/233

(58) Field of Search ..... 209/10, 12.1, 19, 209/20, 44, 44.3, 270, 293, 294, 379, 476, 682; 110/229, 233, 234, 259, 263

(56) References Cited

U.S. PATENT DOCUMENTS

| | | | | | |
|---|---|---|---|---|---|
| 3,784,007 | A | * | 1/1974 | Skrmetta | 209/682 X |
| 4,194,971 | A | * | 3/1980 | Beeckmans | 209/476 X |
| 4,569,446 | A | * | 2/1986 | Kelley | 209/682 X |
| 4,878,440 | A | * | 11/1989 | Tratz et al. | 110/233 |
| 5,669,317 | A | * | 9/1997 | May et al. | 110/229 |
| 6,360,895 | B1 | * | 3/2002 | Riggenmann et al. | 209/682 |

* cited by examiner

*Primary Examiner*—Tuan N. Nguyen
(74) *Attorney, Agent, or Firm*—Laurence A. Greenberg; Werner H. Stemer; Ralph E. Locher

(57) ABSTRACT

In order to separate a carbon-containing fraction as completely as possible from a residue, for example a pyrolysis residue, a combustible constituent is first separated from a non-combustible constituent. A carbon-containing light fraction is subsequently separated from a small-fragment fraction of the non-combustible constituent. For this purpose, in a preferred embodiment, a combination of a facility for the separation of wire with a heavy-fragment separator following the latter is provided for a continuous separation operation. The carbon-containing fraction thus obtained is preferably supplied for further utilization to a combustion chamber of a pyrolysis plant.

6 Claims, 4 Drawing Sheets

PLANT FOR THE PROCESSING OF RESIDUE FROM A THERMAL WASTE DISPOSAL PLANT

CROSS-REFERENCE TO RELATED APPLICATION

This is a continuation of copending International Application PCT/DE99/01449, filed May 12, 1999, which designated the United States.

BACKGROUND OF THE INVENTION

Field of the Invention

The invention relates to a plant for the processing of residue from a thermal waste disposal plant. The residue has a combustible carbon-containing constituent and a non-combustible constituent, and the plant has a first device for the substantial separation of the combustible constituent from the non-combustible constituent.

For ecological and economic reasons, in thermal waste disposal plants, particularly in pyrolysis plants, the residue occurring during thermal treatment is sorted and, if possible, reused. The aim, in this case, is to separate the residue into the carbon-containing combustible constituent and into the non-combustible constituent.

Published, European Patent Application EP 0 302 310 A and the company publication "Die Schwel-Brenn-Anlage, eine Verfahrensbeschreibung" ["The Low-Temperature Carbonization Incineration Plant, A Process Description"], published by Siemens AG, Berlin and Munich, 1996, disclose, as a pyrolysis plant, a so-called low-temperature carbonization incineration plant, in which essentially a two-stage method is carried out. In the first stage, the waste delivered is introduced into a low-temperature carbonization drum (pyrolysis reactor) and is carbonized at low temperature (pyrolyzed). During pyrolysis, low-temperature carbonization gas and pyrolysis residue are obtained in the low-temperature carbonization drum. The low-temperature carbonization gas is burnt, together with combustible fragments of the pyrolysis residue, in a high-temperature combustion chamber at temperatures of approximately 1200° C. The exhaust gases occurring at the same time are subsequently purified.

The pyrolysis residue also has, in addition to the combustible fragments, a large proportion of non-combustible fragments. The non-combustible constituents are composed essentially of an inert fraction, which contains glass, stone, and ceramic fragments, and of a metal fraction. The latter can be divided into a non-ferrous fraction and a ferrous fraction. The non-combustible constituents are sorted out as residues and supplied for re-utilization. For ecological reasons, which are also reflected in statutory regulations, the proportion of carbon in the non-combustible constituents should be as low as possible.

Published, European Patent Application EP 0 144 535 A2 discloses a method for the thermal treatment of waste with re-utilization of the residue obtained, in which, in a first screening, a coarse fraction is separated from the pyrolysis residue and the remaining smaller fraction is subjected to a second screening. The two fractions obtained during the second screening are each subjected to air separation, in order to separate a low-carbon heavy fraction from a carbon-rich light fraction. The carbon-rich light fraction is supplied for energy utilization and the low-carbon fraction is intended for dumping or, for example, for road construction.

A method for the processing of light shredder refuse, which occurs during the comminution of metal-containing residues, for example when cars are being crushed, is described in Published, Non-Prosecuted German Patent Application DE 44 26 503 A1. During this processing, after screening there is provision for the separation of pellets, this being followed by classifying in order to separate a very light plastic fraction. The light fraction separated in this case is added to a fuel fraction.

The problem of the known methods is that the separated non-combustible constituent of the pyrolysis residue, despite being classified, has a considerable proportion of carbon-containing combustible constituents.

SUMMARY OF THE INVENTION

It is accordingly an object of the invention to provide a plant for the processing of residue from a thermal waste disposal plant that overcomes the above-mentioned disadvantages of the prior art devices of this general type, in which the carbon-containing solid fragments are separated essentially completely and reliably in an operation which, in particular, is continuous.

With the foregoing and other objects in view there is provided, in accordance with the invention, a plant for processing a residue from a thermal waste disposal plant, the residue having a combustible carbon-containing constituent and a non-combustible constituent. The plant contains a first device receiving the residue and substantially separating the combustible carbon-containing constituent from the non-combustible constituent. A second device is disposed downstream from the first device and separates the non-combustible constituent into a small fragment fraction and a large fragment fraction. A third device for dividing up the small fragment fraction is disposed downstream of the second device. The third device has a drum with drivers for separating wire-like constituents from the small fragment fraction, a screening device for separating elongated constituents from the small fragment fraction, and a heavy-fragment separator for separating a carbon-containing light fraction still present in the small fragment fraction.

In the plant, the non-combustible constituent is initially essentially separated from the carbon-containing combustible constituent in a first stage in a way known per se. In a second stage, a small-fragment fraction is initially separated from the non-combustible constituent and, subsequently, a carbon-containing light fraction remaining in the small-fragment fraction is separated.

The invention is based on the essential idea that a two-stage separation of the carbon-containing constituents is necessary for effective separation, since the proportion of carbon in the non-combustible constituent is still relatively high after separation in the first stage. The invention, moreover, proceeds from the consideration that the carbon-containing light fraction is located, above all, in the small-fragment fraction of the non-combustible constituent. The separation of the small-fragment fraction and the subsequent separation of the light fraction ensure essentially complete and reliable separation of the carbon-containing constituents from the residue.

The small-fragment fraction is preferably an inert fraction of the residue, since there is a high proportion of carbon-containing particles in the inert fraction. An appropriate plant for separating such an inert fraction is described in German Patent Application 198 22 991.7, titled "Plant For The Treatment Of Solids".

The small-fragment fraction often has, in addition to inerts and the carbon-containing particles, other impurities, in particular in the form of small wires, wire pellets or wire fibers. These may have an extremely disruptive influence in the separation of the light carbon-containing fraction from the heavier fraction of inerts and may impede the continuous and fault-free processing of the small-fragment fraction. Consequently, according to a preferred embodiment, the third device, in which the separation of the carbon-containing constituents from the small-fragment fraction is carried out, contains a facility for separating the wire-like constituents and a heavy-fragment separator, which follows this facility, for separating the carbon-containing solids.

The facility for separating the wire-like constituents advantageously ensures that wire-like constituents, which could cause disruption in the operation of the heavy-fragment separator, are not fed to the latter.

Preferably, the heavy-fragment separator has a housing, through which air is capable of flowing and in which is disposed essentially transversely to the direction of flow a grid, at the opposite ends of which are provided a first outlet for the light fraction and a second outlet for a heavy fraction. Preferably the grid is inclined relative to the horizontal.

In the heavy-fragment separator, air is blown through the grid from below, so that the fed solids are suspended above the grid. In this case, the light fraction is suspended above the heavy fraction, that is to say is separated from the latter.

An alternative method to so-called dry separation by use of an airflow is sink/float separation, in which the light fraction floats in a liquid medium and in which the heavy fraction sinks. A disadvantage of this is that a sludge is obtained, which has to be dried, and that the liquid has to be purified. In the case of the heavy-fragment separator illustrated, through which air flows and which is based on dry separation, post treatment of the separated fractions is advantageously dispensed with.

In order to maintain the operation capacity of the heavy-fraction separator, the previous separation of the wire-like constituents is critically important, since these may catch in the grid and would therefore clog the grid orifices.

For the automatic separation of the light fraction from the heavy fraction, the grid is inclined relative to the horizontal, so that the light fraction slides to the lower end of the grid, whereas the heavy fraction travels to the higher end.

The facility for the separation of wire contains, in an advantageous embodiment, a wire separator having a drum which is rotatable about its longitudinal axis and on the inner wall of which drivers are disposed and in the interior of which is provided a discharge device extending in the direction of the longitudinal axis.

Due to the drivers, in particular wire pellets are separated from the remaining solid fragments and raised in an advantageous way. At the upper reversal point, the wire pellets fall down from the drivers due to their own weight and pass on to the discharge device, by which they are removed.

Preferably, the discharge device has a vibrating conveyor that is followed by a screen, so that, by the vibrating movement of the vibrating conveyor, fine solids adhering to the wire pellets are first released from these and are subsequently separated by the screen.

In this case, the screen preferably contains lamellae that overlap in the conveying direction, there being formed between two overlapping lamellae a preferably obliquely extending gap, through which the separated small solid fragments can fall, whereas the pellets slide over the lamellae.

In an advantageous configuration, the facility for the separation of wire has a screening device for the elongate wire-like constituents, which preferably follows the wire separator. The screening device serves for the separation of elongate small wire pieces, such as, for example, small conductor wires or wire fibers, which are still contained in the solids. Preferably, the screening device contains a vibrating floor with a number of longitudinal grooves extending in the conveying direction. These are followed by screening orifices for the separation of the elongate solid fragments, the groove depth of the longitudinal grooves decreasing in the conveying direction.

Other features which are considered as characteristic for the invention are set forth in the appended claims.

Although the invention is illustrated and described herein as embodied in a plant for the processing of residue from a thermal waste disposal plant, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
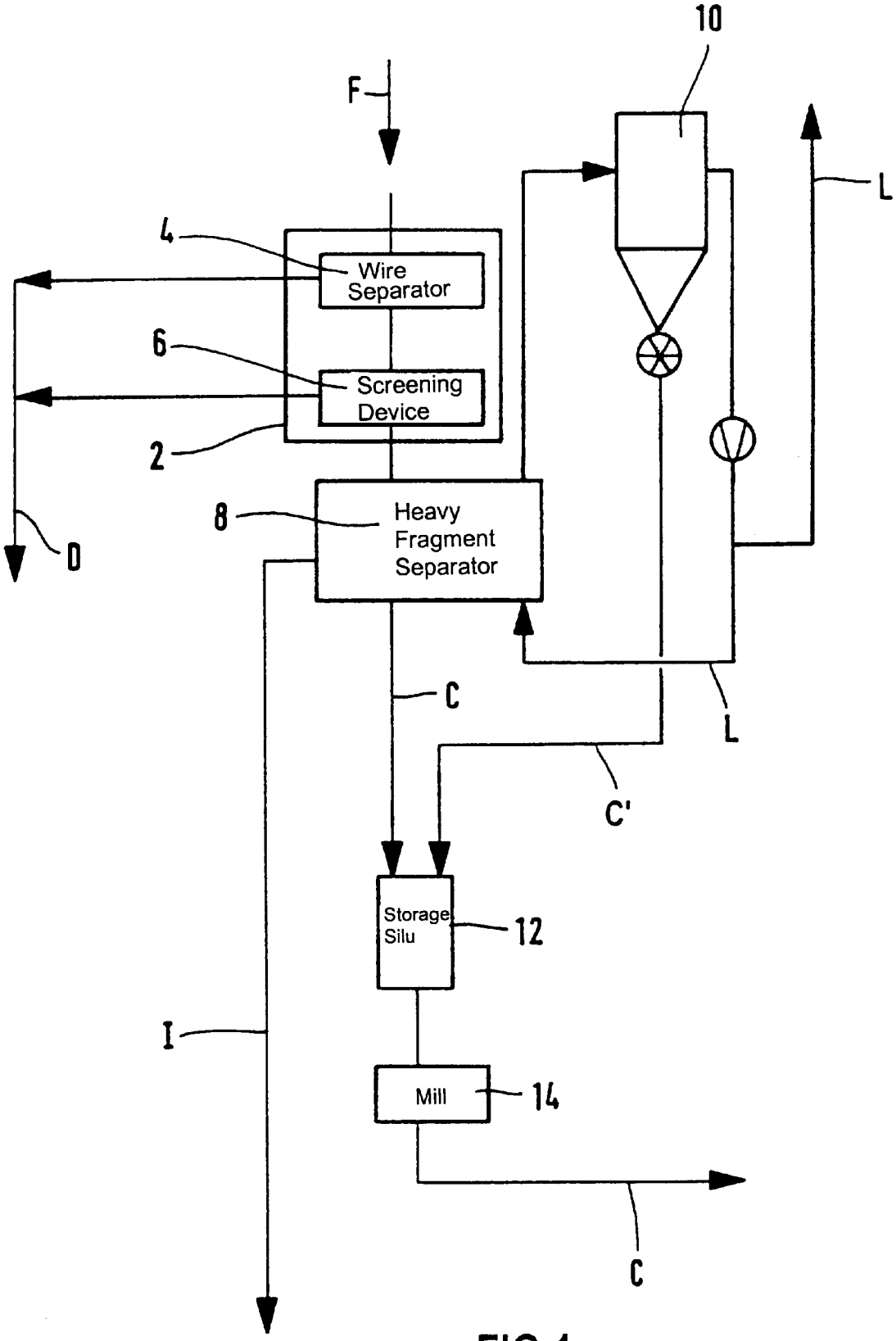
FIG. 1 is a block diagram of a plant for processing a small-fragment fraction according to the invention.

In all the figures of the drawing, sub-features and integral parts that correspond to one another bear the same reference symbol in each case. Referring now to the figures of the drawing in detail and first, particularly, to FIG. 1 thereof, there is shown a solid F that is first supplied as a small-fragment fraction to a facility 2 for the separation of wire-like constituents D. The facility 2 contains a wire separator 4 and a screening device 6 for screening out elongated wire pieces. The facility 2 is followed by a heavy-fragment separator 8, through which air L flows. The air L discharged from the heavy-fragment separator 8 is purified in a filter 10, before it is either supplied to the heavy-fragment separator 8 again or, for example, used as combustion air for a combustion chamber, not illustrated in any more detail, belonging to a pyrolysis plant.

In the heavy-fragment separator 8, the solid F freed of the wire-like constituents D is separated into a heavy-fragment fraction I, which mainly has inerts, and into a light fraction C, which mainly has carbon-containing constituents. The light fraction C is supplied, together with a light fraction C' separated as filter dust from the filter 10, to a storage silo 12 and is led from there to a mill 14. The light fraction C comminuted in the mill 14 to grain sizes having a diameter of preferably a few millimeters is supplied, for example, as fuel to a combustion chamber which is not illustrated in any more detail.

The solid F fed to the plant contains, in particular, inerts, carbon-containing solids and wire-like constituents D and preferably has particle sizes of a few centimeters. The solid F originates, for example, from an inert fraction that was separated, in a pyrolysis process, from the pyrolysis residue obtained during this time (see in this respect, FIG. 6 with the associated description).

The wire-containing constituents which form a pellet G are separated in the wire separator 4, and the elongated wire pieces, in particular wire conductors, are subsequently separated in the screening device 6. The facility 2 ensures a virtually complete separation of any wire-like constituents D from the solid F. This is achieved by the advantageous combination of the wire separator 4 with the screening device 6.

The wire-free solid F, which then only has the inerts as the heavy fraction I and the carbon-containing constituents as the light fraction C, is supplied to the heavy-fragment separator 8. In the heavy-fragment separator 8, the separation of the carbon-containing light fraction C is carried out, so that the heavy fraction I containing inerts is virtually carbon-free and can be used, for example, in road construction.

Figure 2:
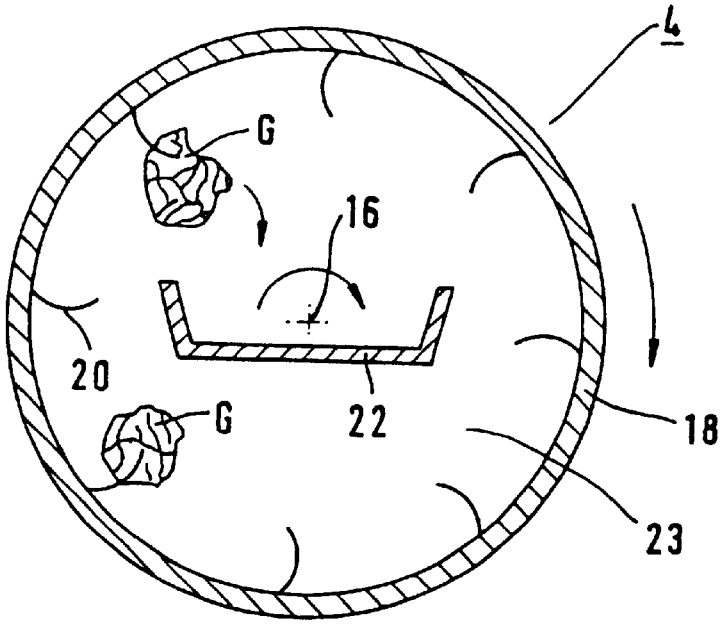
FIG. 2 is a sectional view of a wire separator.

According to FIG. 2, the wire separator 4 is configured as a drum 18 which is rotatable about its longitudinal axis 16 and on an inner wall of which are disposed, for example, hook-shaped drivers 20. only the pellets G catch on the drivers 20, and are driven and raised by the drivers 20. The remaining constituents of the solid F fall down from the drivers 20 during the rotational movement. At an upper reversal point, the pellets G fall down onto a discharge device 22 that is fixed with respect to the rotation of the drum 18. The discharge device 22 is disposed in an interior 23 of the drum 18 and extends in the direction of the longitudinal axis 16.

Figure 3:
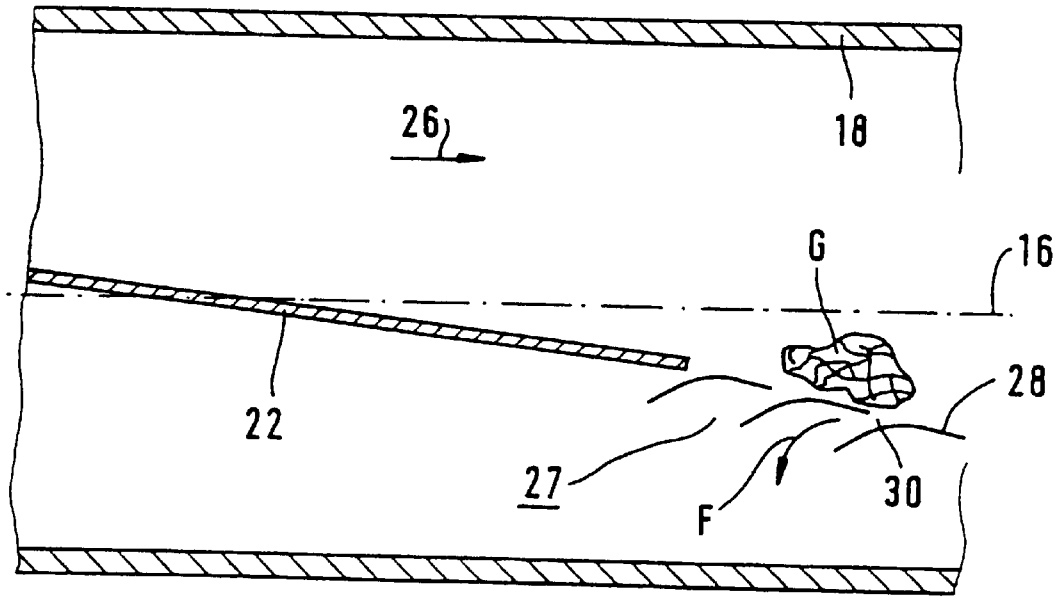
FIG. 3 is a fragmented, longitudinal, sectional view through a part of the wire separator.

As illustrated in FIG. 3, the discharge device 22 is preferably disposed obliquely to the longitudinal axis 16 of the drum 18, and is configured, in particular, as a vibrating conveyor with a screen 27 following the latter in a conveying direction 26. The screen 27 preferably is formed of individual lamellae 28. As a result of the vibrating movement of the vibrating conveyor 22, the solid fragments F adhering to the pellets G are separated from these and are transported further in the direction of the screen 27.

The lamellae 28 are bent and, in particular, are configured approximately as a horizontal "L".They overlap one another, so that a gap 30 is formed in each case between the individual lamellae 28. The solid F separated from the pellets G can fall through the gap 30, while the pellets G slide over the screen 27. The separated solid F falls back into the drum 18 again.

Figure 4:
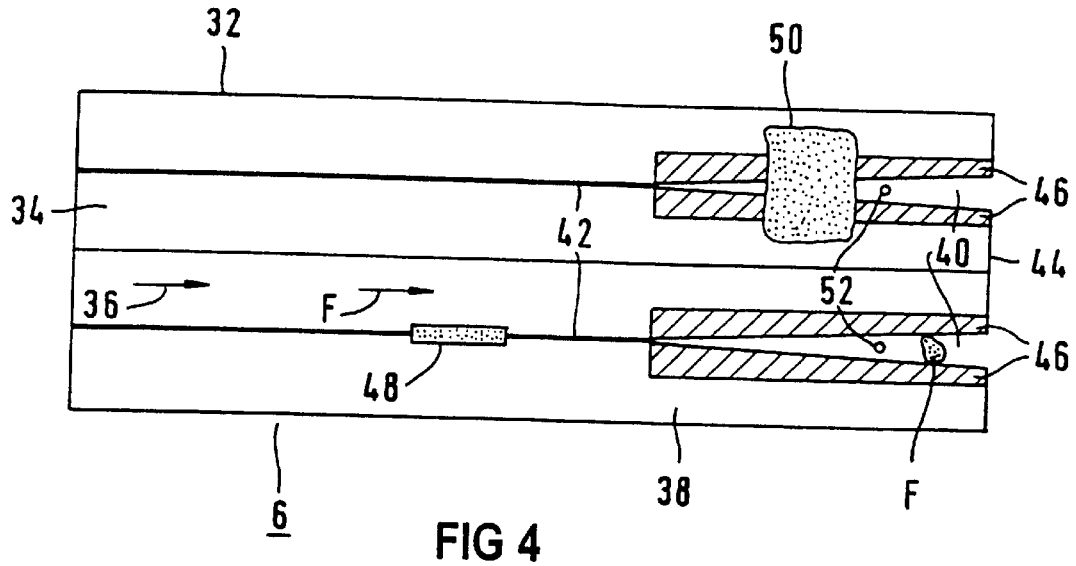
FIG. 4 is a sectional view of a screening device for elongated solid fragments.

FIG. 4 shows the screening device 6, configured as a finger screen, for the separation of the elongated wire pieces. According to FIG. 4, a vibrating floor 32 extends from a feed region 34 for the solid F freed of the pellets, in a conveying direction 36, as far as a separation region 38. The latter has a number of screening orifices 40 which run a V-shaped manner in the conveying direction 36 and two of which are illustrated. A longitudinal groove 42 of the vibrating floor 32 opens into each of screening orifices 40. The screening orifices 40 therefore follow the longitudinal grooves 42 in the conveying direction 36 and, starting from these, widen continuously as far as an end 44 of the separating device 6.

A groove depth of the longitudinal grooves 42 decreases toward the screening orifices 40. The vibrating floor 32 has, in particular, a sawtooth-like or a wavy profile. The longitudinal grooves 42 are formed by the elevations and depressions of a profiled vibrating floor 32.

The two lateral edges of the respective screening orifices 40 are constructed elastically, in particular as elastic tabs 46. The tabs 46 are of approximately triangular shape, so that the V-shaped widening of the screening orifices 40 is formed by the two attached tabs 46.

The solid F is fed onto the vibrating floor 32 in the feed region 34. By virtue of the vibrations of the vibrating floor 32, the solid F is transported in the conveying direction 36. Moreover, the vibrations of the vibrating floor 32 cause elongate solid fragments 48, in particular wire fibers or conductor wires, to be aligned in the longitudinal grooves 42 in the conveying direction 36. The vibrating floor 32 therefore ensures the solids F are conveyed and, at the same time, that the elongated solid fragments 48 are aligned. The vibrations are generated with the aid of a shaking drive, for example an eccentric drive.

It is sufficient if the longitudinal grooves 42, before merging into the screening orifices 40, have only a small groove depth which is adequate for transferring the elongate solid fragments 48, once aligned, in alignment in the conveying direction 36. The vibrating floor 32 may therefore be of virtually planar construction in the region immediately in front of the screening orifices 40. As a result of the decreasing groove depth, sheet-like solid fragments 50 are oriented flat and essentially parallel to the plane of the vibrating floor. The shaking or vibrating movement of the vibrating floor 32 assists in laying the sheet-like solid fragments 50 flat.

The aligned elongated solid fragments 48 fall through the screening orifice 40 and are thus separated from the remaining solid F. By contrast, the sheet-like solid fragments 50, although initially likewise being aligned by the longitudinal grooves 42, are then laid flat on account of the decreasing groove depth, so that they slide over the screening orifices 40 as far as the end 44 of the separating device.

FIG. 4 shows, furthermore, in each of the two screening orifices 40, a tine 52 of a cleaning rake not illustrated in any more detail. The tines 52 are introduced from below, in the region near the longitudinal grooves 42, into the screening orifices 40 and are guided along in these in the conveying direction 36. At the same time, they push the solid fragment F, which has become jammed, further in the conveying direction 36, so that the latter is released and falls through the screening orifice 40 due to the widening of the latter. On account of the elastic construction of the edges of the screening orifices 40, the solid fragment F can be jammed with only relatively little force, so that the stress on the tines 52 and therefore on the cleaning rake is likewise relatively low. After the cleaning rake has been guided in the conveying direction 36 through the screening orifices 40 as far as the end 44 of the separating device, the rake is drawn out of the screening orifices 40 and moved back to its initial position at the start of the screening orifices 40, where the tines 52 can once again be introduced into these.

The screening device 6 described corresponds essentially to the "separating device for elongate solid fragments" described in German Patent Application 198 22 996.8 and this reference is hereby incorporated herein. Other advantageous embodiments may be gathered from it.

Figure 5:
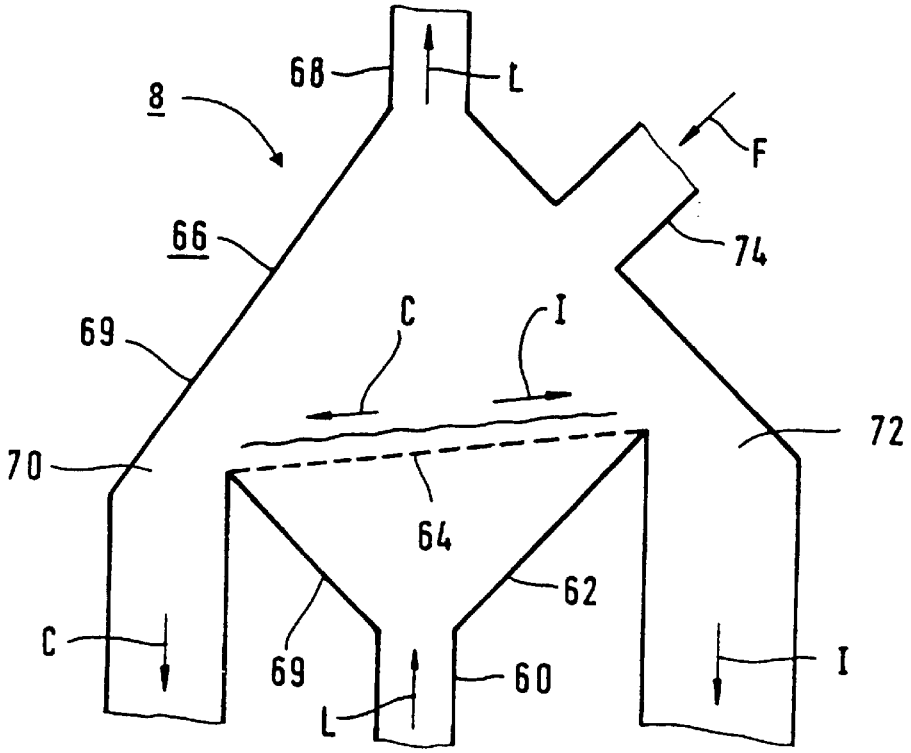
FIG. 5 is a view of a heavy-fragment separator.

FIG. 5 illustrates a particularly preferred configuration of the heavy-fragment separator 8. According to this embodiment, air L is supplied to the heavy-fragment separator 8 from below via a duct 60. The duct 60 widens in the direction of flow of the air L and, as seen in section, forms an approximately V-shaped body 62. Disposed on the latter is a grid 64, through which the air L flows. The air L is diverted from an extraction facility 66 which is likewise of approximately V-shaped configuration and is pulled with its orifice over the grid 64. The extraction facility 66 opens into an extraction duct 68. The extraction facility 66 and body 62 essentially form a housing 69 of the heavy-fragment separator 8. The solid F is fed via a feed device 74 which is disposed laterally on the extraction device 66.

The grid 64 is inclined obliquely to the horizontal. Between it and the extraction device 66, a first outlet 70 for a light fraction C is disposed at the lower end of the grid 64 and a second outlet 72 for a heavy fraction I is disposed at its higher end. The heavy fraction I is essentially carbon-free and has, virtually exclusively, inerts. By contrast, the light fraction C is highly carbon-rich.

By virtue of the air flow, an air cushion is produced immediately above the grid 64 which is configured, for example, as a perforated plate. For this purpose, the perforated plate has, for example, holes with a diameter in the millimeter range. The heavy fraction I and the light fraction C are suspended on the air cushion. The latter is suspended above the heavy fraction I and "floats" on this, so that the two fractions are separated from one another. Due to the oblique arrangement of the grid 64, the light fraction C travels to the lower first outlet 70 and the heavy-fragment fraction I to the higher second outlet 72.

The heavy-fragment separator 8 achieves, in a simple way, virtually complete separation of the carbon-containing light fraction C from the inert fraction I. A light fraction C having a high proportion of carbon and therefore a high calorific value is therefore obtained. The light fraction C is preferably utilized thermally in a combustion chamber. The reliable separation of the light fraction C in a continuous operation is made possible by the particularly advantageous combination of the wire separator 4, screening device 6 and heavy-fragment separator 8.

Figure 6:
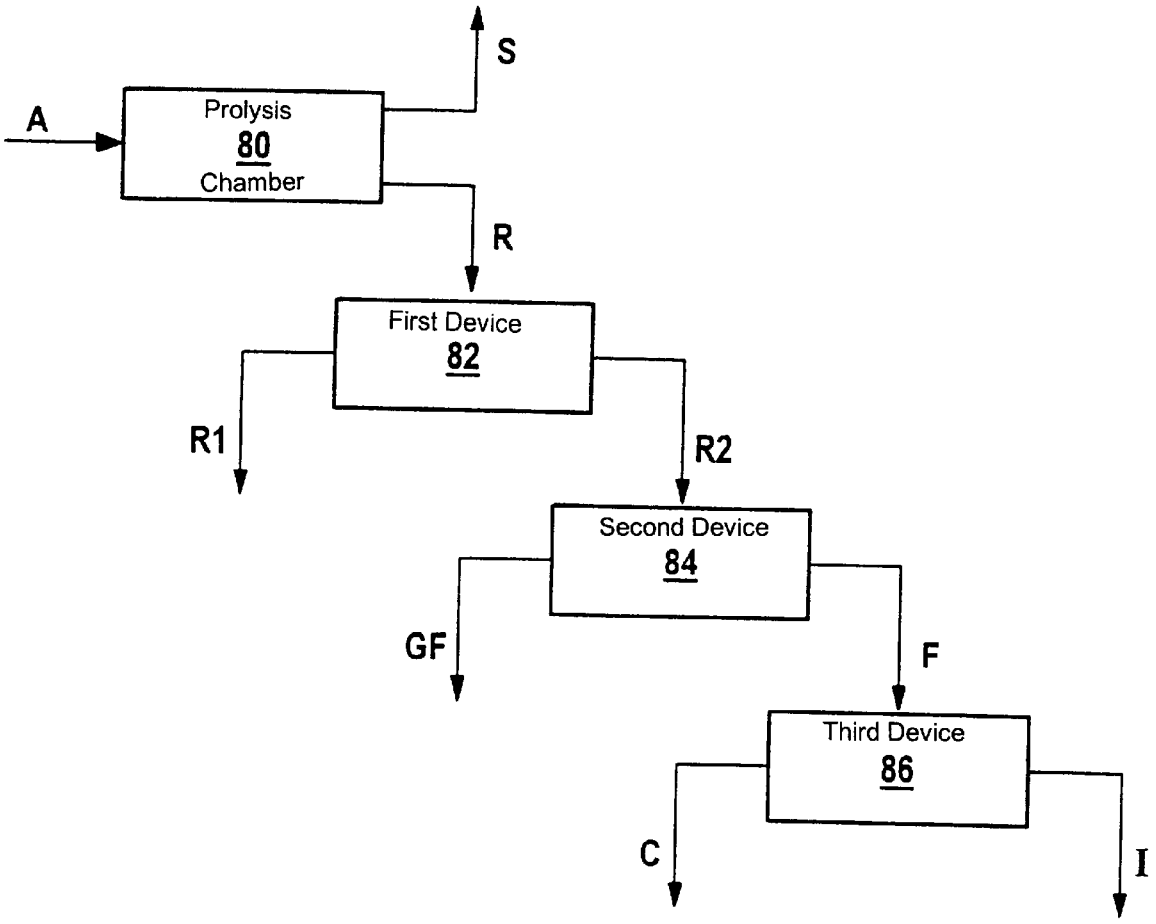
FIG. 6 is a block diagram of the plant for the thermal treatment of waste, with connected residue processing, in which a two-stage separation of carbon-containing constituents is provided.

In the plant for the thermal utilization of waste A, as illustrated in FIG. 6, the waste is supplied to a pyrolysis chamber 80 and pyrolyzed. At the same time, a low-temperature carbonization gas S and a pyrolysis residue R are obtained. The low-temperature carbonization gas S is delivered, for example, to a combustion chamber, not illustrated in any more detail, for energy utilization. In order to treat the residue R, the latter is first separated, in a first device 82, into a combustible carbon-rich constituent R1 and a non-combustible low-carbon constituent R2. The non-combustible constituent R2 also has, in addition to ferrous and non-ferrous constituents as well as inerts, carbon-containing solids which, in particular, adhere to the small solid fragments. Consequently, in a second device 84, separation of a coarse solid GF from the small-fragment fraction, that is to say from the fine solid F, is provided. In order to separate the carbon-containing light fraction C from the heavy-fragment fraction I of the fine solid F, the latter is supplied to a third device 86. In order to process the small-fragment fraction, preferably the ferrous metals, the non-ferrous metals and the inerts of the non-combustible constituent R2 are first separated from one another. A small-fragment fraction is subsequently separated from the inerts, since, essentially, the remaining proportion of carbon in the non-combustible constituent R2 is contained in this small-fragment fraction.

The first, second and third devices 82, 84, 86 each preferably have a plurality of components for a good separating result. The third device 86 contains, in particular, the components illustrated in FIG. 1.

We claim:

1. A plant for processing a residue from a thermal waste disposal plant, the residue having a combustible carbon-containing constituent and a non-combustible constituent, the plant comprising:

a first device receiving the residue and substantially separating the combustible carbon-containing constituent from the non-combustible constituent;

a second device disposed downstream from said first device and separating the non-combustible constituent into a small fragment fraction and a large fragment fraction; and a third device for dividing up the small fragment fraction and disposed downstream of said second device, said third device having a drum with drivers for separating wire-like constituents from the small fragment fraction, a screening device for separating elongated constituents from the small fragment fraction, and a heavy-fragment separator for separating a carbon-containing light fraction still present in the small fragment fraction.

2. The plant according to claim 1, wherein said heavy-fragment separator, includes:

a housing for conducting an air flow therethrough;

a grid disposed in said housing substantially transversely to a direction of flow of the air;

a first outlet formed in said housing at one end of said grid for conducting the carbon-containing light fraction; and a second outlet formed in said housing for conducting a heavy fraction.

3. The plant according to claim 2, wherein said grid is inclined relative to a horizontal.

4. The plant according to claim 1, wherein said drum has a longitudinal axis and is rotatable about said longitudinal axis, said drum has an inner wall and said drivers are disposed on said inner wall of said drum, said drum has an interior formed therein, and a discharge device is disposed in said interior extending in a direction of said longitudinal axis of said drum.

5. The plant according to claim 4, wherein said discharge device has a vibrating conveyor part and a screen disposed downstream of said vibrating conveyor.

6. The plant according to claim 1, wherein said screening device is disposed downstream of said drum.

* * * * *